US008333380B2

(12) United States Patent
Berkowitz

(10) Patent No.: US 8,333,380 B2
(45) Date of Patent: Dec. 18, 2012

(54) INSTANT LOTTERY GAME TICKET AND METHOD OF PLAYING SAME

(75) Inventor: Norman G. Berkowitz, Slatington, PA (US)

(73) Assignee: Markman Holdings, LLC, Las Vegas, NV (US)

( * ) Notice: Subject to any disclaimer, the term of this patent is extended or adjusted under 35 U.S.C. 154(b) by 230 days.

(21) Appl. No.: 11/983,534

(22) Filed: Nov. 9, 2007

(65) Prior Publication Data

US 2009/0121425 A1 May 14, 2009

(51) Int. Cl.
*A63B 71/00* (2006.01)

(52) U.S. Cl. ..... 273/139

(58) Field of Classification Search ..... 273/138
See application file for complete search history.

(56) References Cited

U.S. PATENT DOCUMENTS

| | | | | |
|---|---|---|---|---|
| 5,118,100 | A | 6/1992 | Gumina | |
| 5,743,524 | A | 4/1998 | Nannicola | |
| 5,934,671 | A | 8/1999 | Harrison | |
| 6,682,420 | B2 | 1/2004 | Webb et al. | |
| 6,932,340 | B1 | 8/2005 | Schaefer et al. | |
| 7,004,506 | B2 * | 2/2006 | Downes et al. | 283/62 |
| 2002/0036380 | A1 | 3/2002 | Perrie et al. | |
| 2003/0047869 | A1 * | 3/2003 | Walker et al. | 273/139 |
| 2003/0184012 | A1 | 10/2003 | Green | |
| 2004/0082373 | A1 | 4/2004 | Cole et al. | |
| 2004/0176158 | A1 * | 9/2004 | Baldwin | 463/17 |
| 2006/0178194 | A1 | 8/2006 | Jubinville et al. | |
| 2006/0261545 | A1 * | 11/2006 | Rogers | 273/139 |
| 2006/0271433 | A1 | 11/2006 | Hughes | |
| 2009/0124364 | A1 * | 5/2009 | Cuddy et al. | 463/27 |

FOREIGN PATENT DOCUMENTS

WO WO2004103496 A1 12/2004

* cited by examiner

*Primary Examiner* — Michael Dennis
(74) *Attorney, Agent, or Firm* — Charles A. Wilkinson; Clinton H. Wilkinson

(57) ABSTRACT

An instant lottery ticket game wherein a scratch-off material is removed from a first playing area of the ticket, and if three or more like kind outcome indicia are revealed, the ticket is a winner; however, if three or more like kind outcome indicia are not revealed in the first playing area, a scratch-off covering material is removed from a second playing area to reveal a "Bonus" prize award, so that every ticket is a winning ticket.

11 Claims, 8 Drawing Sheets

INSTANT LOTTERY GAME TICKET AND METHOD OF PLAYING SAME

1. FIELD OF THE INVENTION

The present invention relates to a game apparatus and method of play of a game of chance, and more particularly to a lottery-style game wherein when a desired result is not achieved in a first part of the game, the player is nevertheless eligible to receive a bonus in another part of the game. More particularly still in the instant invention every player is guaranteed to receive some amount back therefore is a guaranteed winner.

2. BACKGROUND OF THE INVENTION

Lottery style games may be defined as any game of chance where the player pays for the opportunity to win a prize, and whether or not the player wins the prize is determined solely by chance, with no skill involved on the part of the player. Such games are of course very popular and widely practiced or played. Instant scratch-off lottery tickets, wherein each ticket contains various symbols, each of which is covered by a secure "scratch-off" coating that prevents the player from being able to view the symbol before the coating is scratched off or removed, have been known and in use for several decades, and have steadily increased in popularity. Such instant lotteries appeal to those players who want to know immediately if they have won. Although the average payouts or winnings in such games is smaller than weekly or bi-weekly games such as lotto wherein players are competing for a single large prize in a drawing, in general the odds of winning at least a small prize are substantially higher. Once the coating is scratched off, it is revealed on the spot whether the ticket is a winning or losing ticket.

In order to be profitable to state lottery commissions, such instant lottery games must have a sufficient appeal to entice customers to purchase and play the game in numbers great enough to generate significant revenues. Therefore, new games are continually being introduced in the hope that they will be popular, while older or less popular games are retired or revamped. While such games therefore will have new themes or marketing strategies, on the average, the method of play of most scratch-off games is generally similar. In addition, most are sold for between $5 and $20, the odds of winning a free ticket are fairly good, such as a 1/30 chance, while the odds of winning higher amounts gradually decrease, with the odds of a winning a top prize such as $250,000 being, for example, 1/480,000 or the like. In addition to the standard instant game, in which each ticket is predetermined to be either a winner or loser, some scratch-off games are probability games, wherein every ticket is potentially a winner, but the player must scratch and reveal certain symbol patterns or combinations of symbols to win. While such games are initially interesting, the majority of players seem to lose interest in the games fairly quickly. In addition, players know that even with tickets that provide multiple chances to win, the majority of the time they are not going to win anything, which discourages the casual player. As far as the present inventor is aware, no instant lottery game is in existence wherein every ticket purchased is guaranteed to be a winning ticket, so that players receive a payout from every single ticket. In addition, the present inventor has conceived of such a game having a unique method of play wherein if a player is not a winner in an initial scratch-off game, such player then will be a guaranteed winner in a second "bonus" game on the same lottery ticket. It is believed such method provides a more interesting game that keeps the players attention better than standard instant lottery games, and as a result will generate more income than the standard game.

3. DESCRIPTION OF RELATED ART

U.S. Pat. No. 5,118,100 issued to A. Gremina on Jun. 2, 1992, entitled "Instant Poker Game Card," discloses an instant poker game using scratch-off cards arranged in consecutive order and representing a series of poker hands of multiple players. The results of one card scratch off influences the results of another card scratch off, but otherwise the disclosure has little similarity to the present instant always win lottery game.

U.S. Pat. No. 5,743,524 issued to C. A. Nannicola on Apr. 28, 1998, entitled "Seal Card Game with Random Advanced Player Selection," discloses a mountain climbing theme board game employing seal cards or scratch off cards to indicate which player will be eligible to ascend to a further level in the game. Other than that what is revealed by one card affects what happens with a later card or level the Nannicola game cards have little similarity to the present inventor's instant lottery card.

U.S. Pat. No. 5,934,671 issued to J. E. Harrison on Aug. 10, 1999, entitled "Pull Tab Ticket Game with Both an Instant Win and Bonus Award System," discloses a game card in the form of a pull tab card which is associated with a bonus card for raffles or the like. The concept of always winning does not seem to be disclosed. The invention is directed to identifying and accounting for multiple related tickets, i.e. winning on one may entitle one to another or different game card and the relationship has to be kept track of.

U.S. Published Application No. 2002/0036380 entitled "Poker Dice Casino Game Method of Play," to K. A. Perrie et al. published Mar. 28, 2002 discloses a casino machine for playing poker dice wherein the dice (reproduced upon a machine may have either conventional card faces or alternatively conventional multiple dot dice faces. Hands or turns comprising five dice are used as illustrations, but it is stated that any number of dice could be used. The games disclosed make heavy use of bonuses which it is said may be initiated in any way including the zero wins in a number of previous hands or turns. Bonus games can also be based only upon a chance machine generated throw of dice. The concept of having a winner in every game or on every ticket does not seem to be specifically shown or described, however.

U.S. Pat. No. 6,682,420 issued to B. S. Webb et al. on Jan. 27, 2004, entitled "Gaming Device Having a Primary Game Scheme Involving a Symbol Generator and Secondary Award Triggering Games," discloses a game using a symbol generator such as revolving slot machine reels or dice which in the event of certain combinations entitles or enables the player to enter into certain other games. The concept of passage immediately into a winning bonus upon not initially winning with the symbol generator does not appear to be disclosed.

U.S. Pat. No. 6,932,340 issued to C. M. Schaefer et al. on Aug. 23, 2005, entitled "Method of Playing a Dice Wagering Game," and assigned to West Coast Gaming, Inc. discloses a wagering game using similarities of dice in which a series of five dice hands are rolled for each coin inserted in machine. A bonus roll is attainable but an award of a bonus is apparently dependent only upon previous winning hands. Bonuses are not awarded when there is no winning hand.

U.S. Pat. No. 7,004,506 issued to K. P. Downes et al. on Feb. 28, 2006, entitled "Lottery Ticket Play Action Game," discloses a progressive lottery ticket in which upon winning one level by attaining the desired match one may progress to the next level. A bonus level may finalize the game. There appears to be no disclosure of the concept of progressing to the bonus round upon not winning the earlier round.

U.S. Pat. Application Publication No. 2006/0178194 published to C. Jubinville et al. on Aug. 10, 2006, entitled "Combination Lottery and Raffle Game," combines the concept of a lottery card paying off in another medium namely a raffle-style game after certain wins in the lottery section but not after loss in the lottery section.

OBJECTS OF THE INVENTION

It is therefore a primary object of the invention to provide an instant style lottery ticket or game wherein every ticket is a winning ticket.

It is a further object of the invention to provide a scratch-off instant lottery game, which is generally simulative of a dice game.

If is a still further object of the present invention to provide a method of play of an instant scratch-off style lottery ticket game wherein in a first game, if a player has at least three like symbols, such player is a winner, but if the player does not have at least three like symbols, the player then is guaranteed to receive a guaranteed "Bonus" prize It is a still further object of the present invention to provide an instant lottery ticket game in which there are at least two scratch off sections or similar sections, the first of which has a winner in a number of tickets and a second scratch off or similar sections in which if there is not winner or win in the first section the player goes to the other section where there will be a win.

It is a still further objection of the present invention to provide an instant lottery ticket game in which there are at least two scratch off or similar sections on the ticket, the first of which has a winner in a number of tickets and a second scratch off or similar section in which if there is not a winner or win in the first section the ticket holder goes to the second section where there will be a win and in which the wins in the second section are in general larger than those found in the first section.

Still other objects and advantages of the invention will become clear upon review of the following detailed description in conjunction with the appended drawings.

It is a still further object of the present invention to provide an instant lottery ticket game in which there are two scratch-off or similar sections and in which play progresses from the first section to the second section if no win is had in the first section and wherein relatively small wins can be banked or retained with a bank or the like associated with the ticket providing organization until withdrawn by the player at a later time usually with interest.

SUMMARY OF THE INVENTION

The foregoing objects are attained in the present invention by providing a scratch-off or seal off lottery game wherein in a first game section, if a winning symbolization which becomes evident after removal of the obscuring means, a win of pecuniary or other valuable resources can be collected and, if such a win is not revealed, the player can proceed to a second game section where removal of the obscuring means will reveal a win of pecuniary or other valuable resources which can be collected and in which the initial game section will usually contain more but lesser wins and the second game section will contain fewer but more valuable or greater wins and more particularly where if a player has at least three like symbols or numbers or the like the player receives the cash or other prize associated with that combination. However, if the player does not have at least three like symbols in the first game, such player can then play a second game on the same ticket wherein the player is guaranteed to win a prize of some degree mostly small, but some substantial so that interest in the game is maintained to the last possible time and, so that in effect every lottery game ticket in such game is a winning ticket.

In a desirable form of the invention, the prizes collected which are less than the selling price of the lottery ticket or other fairly small amount may be collected by the player and cashed in periodically as a sort of forced savings which are payable periodically.

DESCRIPTION OF THE PREFERRED EMBODIMENTS

Figure 1:
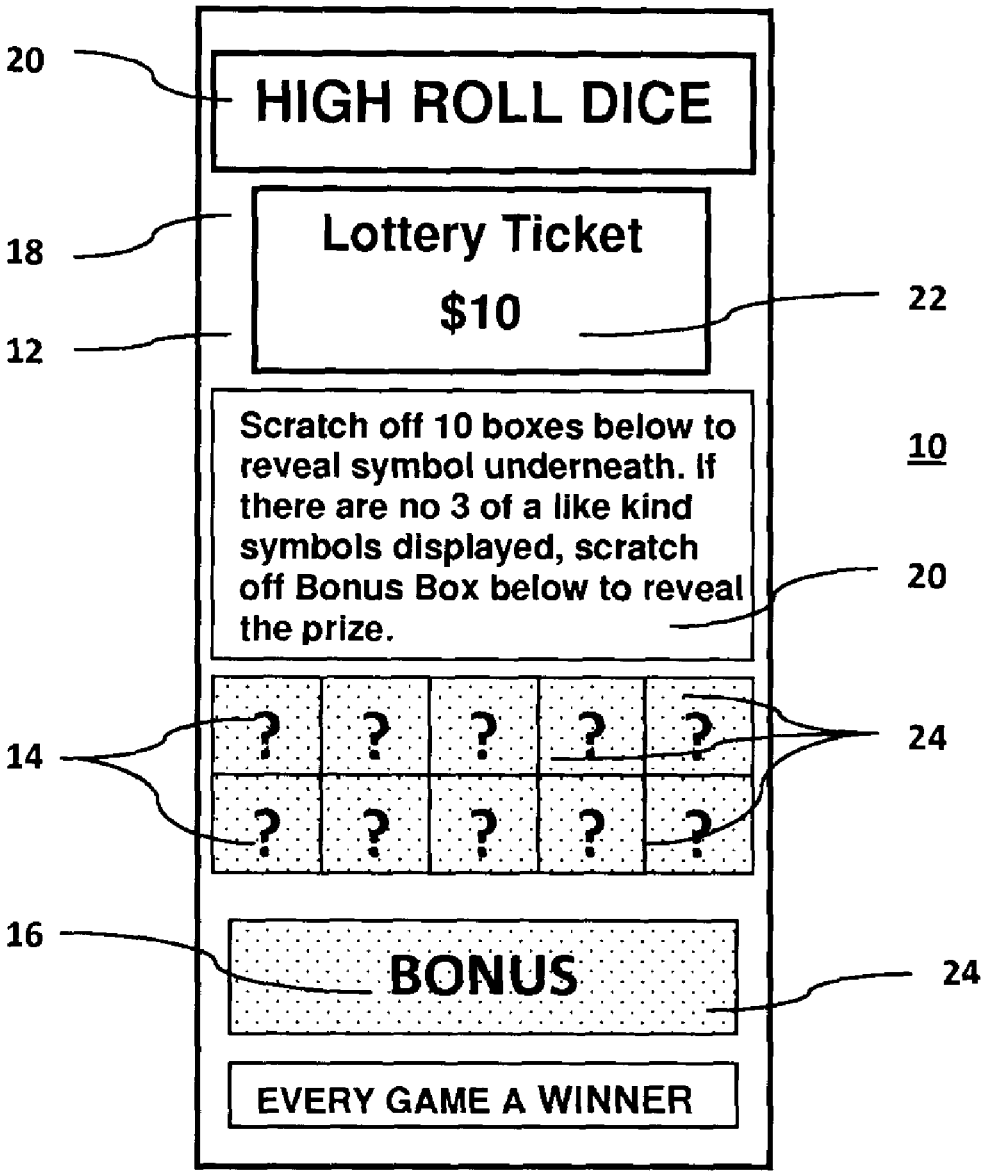
FIG. 1 depicts an instant lottery ticket game in accordance with the system and method of the present invention prior to being played.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

A great many governmental units and particularly state governments have in the more recent past begun to sponsor, if not to operate, general wagering games commonly known as lotteries and are using such games for fund raising purposes. Typically, such lottery games require players to recognize or select certain combinations or permutations of numbers, symbols or the like. Then, periodically, such as once or twice a week, the lottery operation randomly selects, usually by a so-called "draw", the winning combination, which is then compared with what the players had previously selected or purchased to see which player or players matched the draw with their previously selected or purchased combinations.

Such lotteries have become an important source of funds to governmental units, which usually have the power to limit competition with respect to their games. The success of state lotteries has made them very important games in the universe of games, particularly as they represent such an important source of funds for governmental units and this has made the devising of new and more successful games to keep these important sources of funds flowing also very important, particularly as the interest of the gaming public is "fickle" and such public can easily tire of certain games and seek more interesting games, seriously cutting into the funds generated for such government units unless other interesting games are devised to take the place of games the public has tired of. The very fact that in high win games the number of winners is necessarily small tends to make the players lose interest in the games they have been regularly playing and which have come by regular association to suggest "not winning" to such players. Thus, the players are often ripe for playing new games with no prior negative associations perhaps put forth by competing governmental units. One way to try to maintain interest is to give a number of smaller prizes or wins along with the large prize, those occasional gamblers winning the smaller prizes thereby having their appetite "wetted," so to speak, by the smaller prizes for the winning of the big prize, which is always the main attraction of the game.

It has become a challenge, therefore, to develop new and more attractive games to keep the public's interest up in such games upon which so much of many governmental entities funds are dependent.

One particular type of lottery game is the instant win game, where the game player need not wait for an organized draw to find whether they have a win or the like. Instant win type lottery tickets are provided not only by governmental units, but are also used by charities and the like often in connection with raffles. Such tickets may be of several kinds, such as so-called break open tickets frequently of the pull tab type where a tab is grasped to either pull out a designation such as a designation of what if anything has been won or one or more symbols or combinations of symbols which can be matched against an already revealed winning combination, frequently revealed in advertising. Alternatively, the break open card can designate in a separate tab or break open spaces both the winning combination and what combination the player has been assigned as such player's designation.

Another type of instant win card or game arrangement is a so-called seal card in which information respecting what the player has been assigned by chance is revealed by breaking open a sealed point or area on the card revealing below one or more combinations of potentially winning symbols or the like. A variation of the seal card is a so-called scratch off card. These cards are provided with an obscuring layer of opaque material over the surface of the game spaces, which can easily be scratched off to reveal symbols and/or numbers or alphanumeric numerals underneath. Once such obscuring material is scratched off, it is very difficult to replace it and useless in any event as the operator of the game will retain a winning card once payoff of any prize is made. Frequently such cards indicate some sort of secondary bonus indicating frequently the entitlement of the player to another bonus card if a winning number or symbol is revealed by removing the obscuring coating.

Today, scratch off lottery tickets or cards are widely used in the lottery industry. As indicated above, the necessary or desirable game data is covered by the scratch off layer or other obscuring material and is exposed when the scratch off layer is removed. Usually, once the scratch off layer is removed, the necessary game data is revealed and if a winning combination such as the ubiquitous "three of a kind" or some variation thereof is revealed, the player may be entitled to a prize. Usually it is required that the player remove the obscuring layer and determine if a win has been made, at which point usually the ticket can be turned in to retrieve whatever the prize is and the player no longer has the used ticket and thus no opportunity to try to use the ticket again. It is this type of ticket which has been found to be particularly appropriate to the present inventor's game, but as will be recognized the always win game of the present inventor would be adaptable to any sort of seal type game apparatus or tickets.

In the past, as noted above, there have been various games of chance in which each player has, at least theoretically, as equal a chance to win as any other player because the skill of the player is not usually an element of play, except to the limited extent of knowing how to play the game. Furthermore, most of such games are made simple to play in order to keep the odds uniform. This makes these types of games particularly attractive to the so-called man, or woman, in the street who then feels he or she has at least an equal chance of winning, no matter how unlikely. Furthermore, the fact that there is an equal chance of winning may frequently give the mathematically unsophisticated gambler a sense of a greater chance of winning than the rather limited chance of winning indicated by the actual odds.

The likelihood of either winning something and the likelihood of such winning being substantial rather critically affects the likelihood of players entering into or playing a lottery or any other game, whether for winnings normally received or winnings occasionally received. In other words, an average player can win smaller amounts more "frequently" or can win larger amounts less frequently. Depending upon their personality and experience, a player may be attracted by a fairly good chance of winning something in a game or may alternatively be attracted by the lesser chance of winning big at widespread intervals. No commercial game can provide the maximum attraction on both accounts, since the persons or parties sponsoring or operating commercial games must be provided with sufficient recompense so that they will take the time and trouble to operate or provide such game to the public. Thus, by mathematical logic it is evident that some players must lose on a mathematical basis to provide money for the operators or "the house" to run the game and provide at least some profit. The present inventor, however, has conceived that if the player knows that he or she would win at least something every time he or she paid to the play the game, that the attractiveness of the game would be increased for most players unless, of course, they were mathematically sophisticated enough to not only realize that the only win that counts is one where the player gets back more than they have invested and to be repelled by the evident truth that in a broad sense over a statistically time significant period the average player cannot make money or else the average operator will go broke. However, there is a difference between being intellectually aware of such fact and acting upon it emotionally and the average player will tend to feel more friendly toward and not be repelled by a game in which they know they will win something in an absolute way if not in a practical sense. Thus, while it is necessary from a mathematic viewpoint that the average player lose money so that the "house" or game operator may make enough money, it is possible for the average player to always get back a portion of what they pay to enter into or play a game and it is this possibility that the present inventor has realized can be used to make a game more attractive psychologically to the average player although possible less attractive intellectually to the more cerebral player who may be "turned off" by, or not attracted to a game which they may feel is somewhat deceptive. However, the very mathematically perceptive person who worries about the odds may not play games of chance to any great extent in any event and there are a great many more average persons playing games of chance than mathematicians playing games of pure or almost pure chance. Meanwhile the man or woman in the street may be enjoying their game giving them something to look forward to each time they play, thus overall adding to the enjoyment and excitement of the game.

The present inventor has engineered a game of chance in which each player wins or gets back some of the funds they have expended to play immediately upon playing or alternatively will receive back some other benefits or goods or other items or privileges of value, usually of lesser value than what they paid to play, while a certain number of wins will be of significant amounts. Such method of play is not deceptive and cannot be compared to artificial biasing of the odds so that a player seems to be coming closer and closer to winning while the odds due to biasing of the same actually becomes less and less favorable. The fact that one is getting back in most plays less than they actually "invested" is not hidden from the player and the game is thus not deceptive. The player, on the other hand, has a more friendly attitude to the game and the "house" since they are getting something with every play and thus "feel" better and are more likely to continue betting instead of becoming bored because they are making no "progress" and have nothing to show for their trouble. Psychologically the player keeps track of what such player is getting back and tells their friends about it, tending to maintain the belief that eventually they will get something valuable back, which is true if the average player continues for a sufficient period. A conversational item is also provided or set up in which the player can always state that they got back so much, going on then, if they wish, to state that although they were back a certain amount by the end of their playing session, the amount they did obtain in such session, which winning amount will make such session of playing seem less onerous or tension inducing than having to say they won nothing whatsoever.

The present inventor prefers to operate his "always win" game as take off on a dice game in which a scratch off ticket or broadly so-called sealed ticket has a series of dice faces hidden behind the seal and in which various combinations, for example, four sixes, are hidden behind the seal and when exposed by breaking the seal or scratching off the covering will allow the player to collect certain prize amounts upon presentation to the game operator. In the preferred form of the game there will be two sealed sections on each ticket of the game, which sealed sections when breached will divulge the combinations won by the player. The first game section when breached may or may not show a winning combination, although in the preferred arrangement the vast majority of the tickets will have some winning combination in the first section. A few of the tickets, however, will not have a winning combination in the first section, in which case the player is authorized to proceed to the open or scratch off the second section which will contain a winning combination and in most cases a fairly substantial win or in a manner of speaking "real money". While it is not necessary that two scratch off or sealed sections be included, it is preferred to use this type of arrangement as it adds to the anticipation and, therefore, the interest of the player. The major winnings could also be in or from the first sealed section. However, if the players after a time learn that the principal prize or prize amounts originate from the first section, they will tend to lose interest in the game after opening the first section and will suffer a psychological letdown losing interest in the game, although in most cases they will proceed to break the seal on the second section also in order to recover their minor prize. However, there will be no or little anticipation and thus the gamblers "high" or excitement or anticipation will be dissipated prematurely. Since it is often such a high which lifts the player's spirits and encourages them to return again and again to obtain as many highs as possible, any premature dissipation of such high or restrained excitement will not normally be a desirable effect.

Since as will be evident from the above, there will be little anticipation in going to the second section if such section contains the smaller prizes, because the player will know at that point that only a partial recovery of their initial investment is likely to be involved, it is desirable, as explained above, to have the minor prizes or recoveries in the first sealed section and the larger in the second. However, it may be advisable to mix up the recoveries from the two sections in order to maintain the playing game of the invention exciting and maintain the gamblers high as long as possible. It will be evident, therefore, that while it is preferred to operate the game in the preferred embodiment, as explained in additional detail below it can be effectively operated in various forms.

The instant inventor, therefore, has conceived of and developed an instant win lottery type game preferably using scratch off type lottery tickets or other types of seal cards in which every ticket, game, or card when opened will reveal a winning of at least a small amount or value which can be collected from the game operator usually immediately, although such small amount could be collected until a larger amount is built up. Such small amounts will by necessity in most cases be less than what was paid for the chance to play or the price of the instant win ticket, although the amounts preferably vary to retain the interest of the players. A percentage of the winnings will, on the other hand, in some tickets be large enough so that the winnings or "jackpots", again preferably of varying amounts and these will be, of course, the ultimate aim of the player. However, the small winnings are useful to the operator in maintaining the interest of the players and maintaining them in a receptive state to continue playing the lottery game of the invention, since small winnings suggest to the player that big winnings are possible and perhaps even more possible than they actually are.

Furthermore, if the players prefer to collect their winnings over a period and then cash them in at a single time, they will begin to look forward to and anticipate such payoff as well and may even play more in order to build up a larger balance. This will have a double benefit for the operator, since such operator will not only sell more of the lottery tickets, but need not take the time to redeem each ticket individually. In order to make multiple redemptions convenient, the tickets may have the winnings electronically coded in them so they can be conveniently passed through a machine validation one after another and the amounts totaled electronically after which the total can be paid out in a lump sum at a convenient time such as before the Christmas holidays or the like. Thus the lottery tickets of the invention can be used as a temporary saving account by the players and this could be further accentuated by the operator by even giving some further bonus for multiple redemptions such as even small interest payments or extra prizes. In this way, the players can feel that they are saving money for worthwhile events as well as playing their favorite gambling game, a sort of combined forced saving along with seeking for a big payout or prize on a random basis. Thus the forced savings of the game will be assured and as regular as the players play sessions and the players can feel morally satisfied as well as obtaining the "gamblers flush". As explained above, the amounts of the numerous regular winnings will preferably vary also in order to maintain the player's interest and excitement although such winnings will be regular in order to fulfill the regular savings aspect of the game. Thus, combining a possible forced savings or pay back feature with an instant lottery game is in itself a desirable addition to such game in order to not only better maintain the player's interest, but also to provide the average player and the player's associates with a better more sanguine feeling concerning their play.

Thus, as indicated above, since in accordance with the game of the bonus lottery card of the invention each play by a user of the machine will result in the payment of some award, either as an initial payout prize in the normal range of lottery card payouts given more frequently, or a bonus prize amount which may be of a higher amount or payout in a second mode of play, but will in every case be something, although by necessity will be less than the price for play amount for most players or the majority of players, such amounts will be fairly small and might not even be collected by the player but discarded by the player as a sign of "disdain" by those players who either are, or fancy themselves, as "high rollers". In a further embodiment of the game, therefore, such small bonus amounts may be accumulated or "banked" by the players with or without interest paid by the casino or an associated bank or banked into state lottery accounts and allowed to be withdrawn at some predetermined future time such as yearly or some special time or such as a holiday, for example, such as Christmas or wedding anniversary or the like. Furthermore, in order to encourage a player to accumulate such bonuses, those who accumulate significant amounts for significant periods may be granted the privilege of entering further drawings or other game chances. For example, a player who had accumulated bonus winnings of $1,000 or more over a two-year period might be eligible to participate in a free drawing for a new automobile or the like, plus be still entitled to the $1,000 or more at interest as a form of forced saving. In such case, of course, the cost of the drawing, i.e. the automobile and associated expenses would be charged against the "house" take of the associated slot machine or machines. In accordance with this further embodiment of the invention, those players who choose to let their small bonus payments accumulate can obtain the psychological benefit of feeling that while they may be overall losing money at gambling, they are nevertheless at the same time saving part of, or a percentage of, everything they are devoting to the playing of their favorite slot machine. Many members of family groups may appreciate this advantage when their spouse does not happen to share their enthusiasm for gambling and even those players who gamble for recreation because they enjoy the excitement and anticipation of winning, but who nevertheless strictly limit their gambling activities to what they can afford, will appreciate the feeling of saving at the same time. The withdrawal of the gamblers "savings" at a wedding anniversary or the like for use in the purchase of a family gift may be particularly appreciated.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

As indicated above, the lottery game of the invention can be provided in a number of forms, but will be described below in the most detail in connection with the inventor's preferred embodiment of the game in which a dice type format is adopted in which every ticket has a number of dice faces shown on a first section of the card revealed by removing a scratch off coating or other obscuring covering and a win is had if there are at least three of a kind dice faces or better revealed out of a total of ten dice faces. A schedule on the other side of the card or ticket then indicates what the reward or winnings are for each three of a kind or better revealed. In the event there is no winning combination, or three of a kind, however, the player can then go to a further bonus scratch off section which will reveal under the coating of a further scratch off section an alternative prize which in the particular embodiment of the game disclosed will usually be a much larger prize and in some instances an actual jackpot or very large prize. It will be evident, however, that the principal of the invention can be incorporated into a number of particular embodiments of the invention too numerous to be included in a single patent document and the claims of the patent should not be considered to be limited to the embodiments shown, except where the language specifically relates to such specific embodiments.

Figure 5:
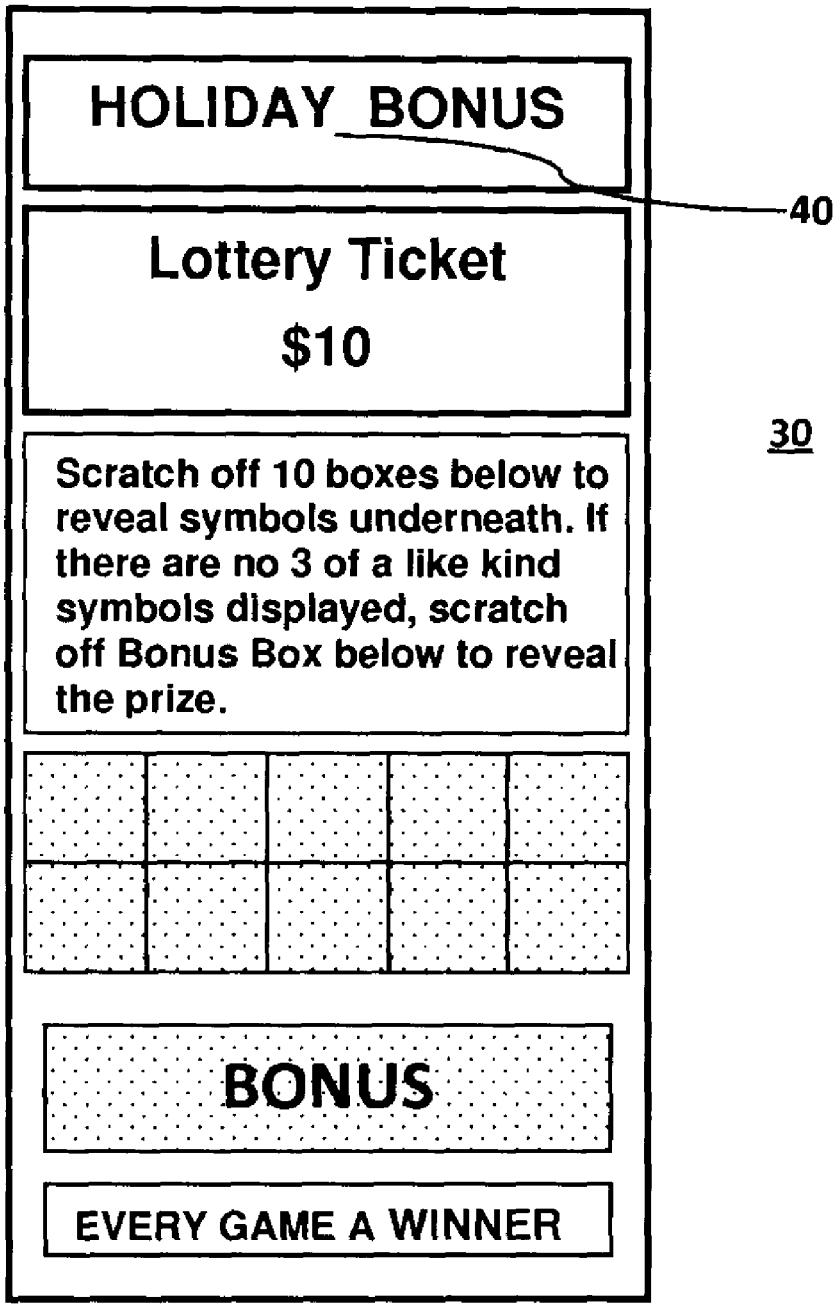
FIG. 5 illustrates a first alternative embodiment of the instant lottery ticket game of the present invention prior to being played.
Figure 6:
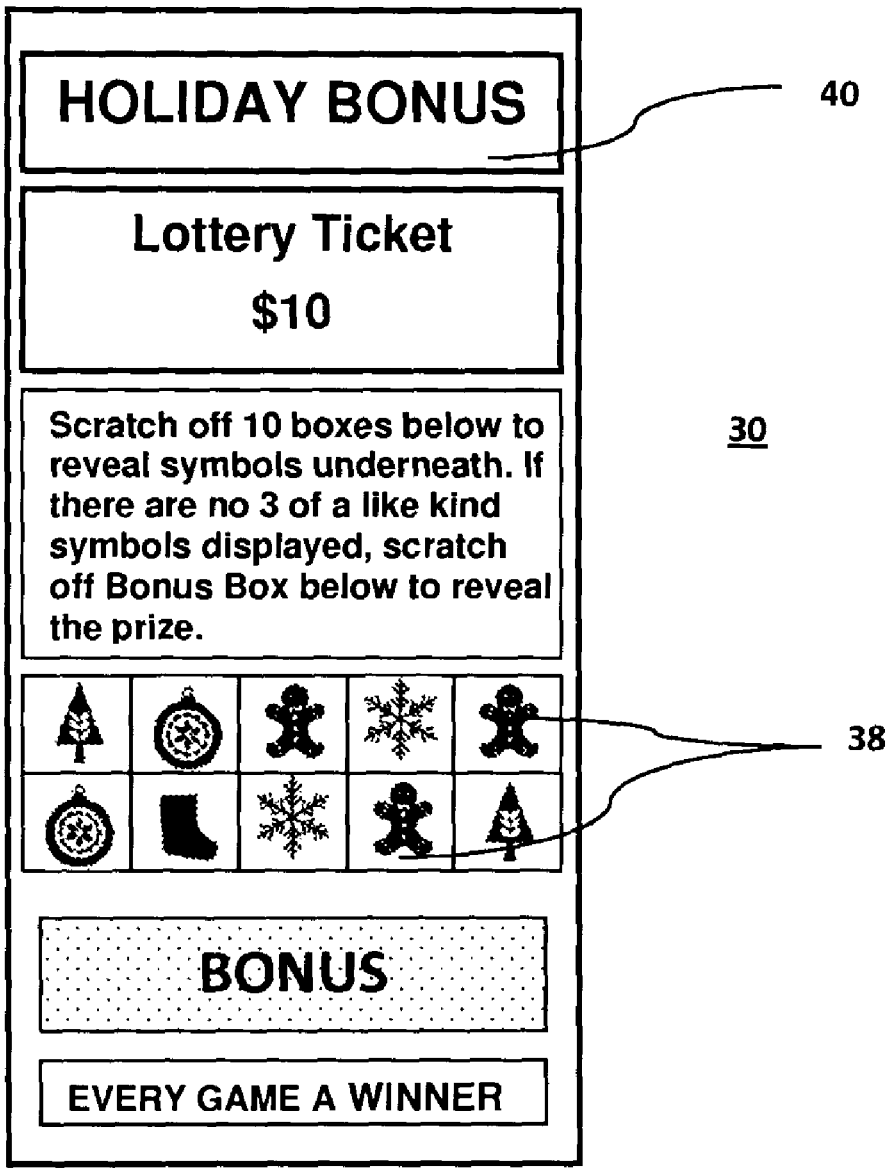
FIG. 6 depicts the instant lottery ticket shown in FIG. 5 with the scratch off material in the first playing section removed illustrating a winning combination and with the ticket symbols having a holiday theme.
Figure 7:
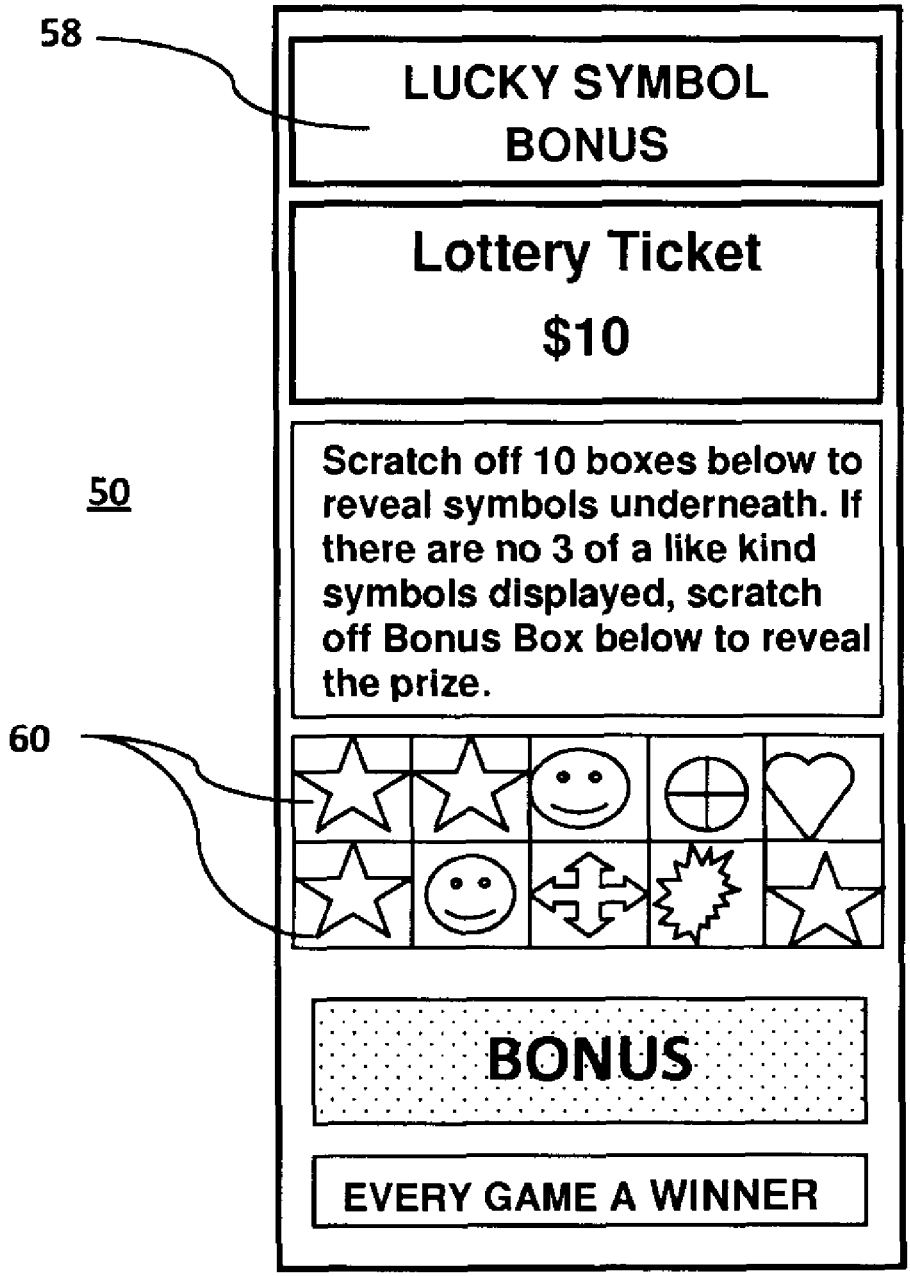
FIG. 7 depicts another alternative embodiment of the instant lottery ticket shown in FIG. 5 having the scratch off material in the first playing section removed illustrating a winning combination and with the spaces having various generic symbols.

As explained generally and described above, the present inventor has conceived of an instant lottery ticket game and method of play, which will be now be described with reference to FIGS. 1-4 which illustrates the applicant's presently preferred embodiment, but should be considered only the presently preferred embodiment and is presented here as an illustration of one desirable way to play the game of the invention. In addition, FIGS. 5-7 illustrate two further preferred alternative embodiments of the tickets or game. In FIG. 1, the front side 12 of an illustrative instant lottery ticket game 10 made from a paper, paper coated, or other suitable material is shown as it might appear before it has been played or sold to a player, with the back or reverse side 13 of such ticket 10 being shown in FIG. 4. Ticket 10 has a first play area or section 14, a second play area or section 16, and a background area or section 18 surrounding such first and second play sections. Included as part of background section 18 is a title section 19 in which the name of the game, in the present example "High Roll Dice", or other indicia is provided. Also provided in background section 18 are instructions 20 for playing the game, while information 21 describing winning combinations and associated payouts that may be won by a player in the present example is provided on back side 13 of ticket 10, although such information may also be provided in background section 18. Other information, such as the price 22 of the ticket, plus any suitable advertising, graphics or other fanciful indicia in accordance with the particular theme of the game may also be provided in background section 18, as well as in play areas 14 and 16 and on back side 13 of the ticket 10. For example, the present game ticket 10 is identified by the legend "High Roll Dice", and therefore might be expected to have a dice game theme, although as indicated above the method of play of such game could be easily incorporated with other themes as the dice are used only symbolically as outcome indicia.

The play areas or sections 14 and 16 of the ticket, which could also be provided as a single section, are provided with certain outcome indicia. As described in more detail below, the outcome indicia in play area 14 will be compared to the payout scale 21 describing winning combinations to determine whether the ticket is a winner in such play area. As shown in FIG. 1, the outcome indicia is initially obscured from view by an alterable opaque covering surface or scratch-off material of a type known to those skilled in the art, such as aluminum permeated latex, indicated in play area 14 by stippling 24. Play area 16 is also covered by a similar scratch-off material, also indicated by stippling 24, which surface will be removed in certain circumstances as described in more detail below. Alternatively, other alterable covering materials or surfaces capable of obscuring or sealing the playing areas may be used, such as a wash-off material made from photosensitive, ink, thermal, or watermarked materials, or a peel-off material, such as a sticker, perforated paper, or the like.

Figure 2:
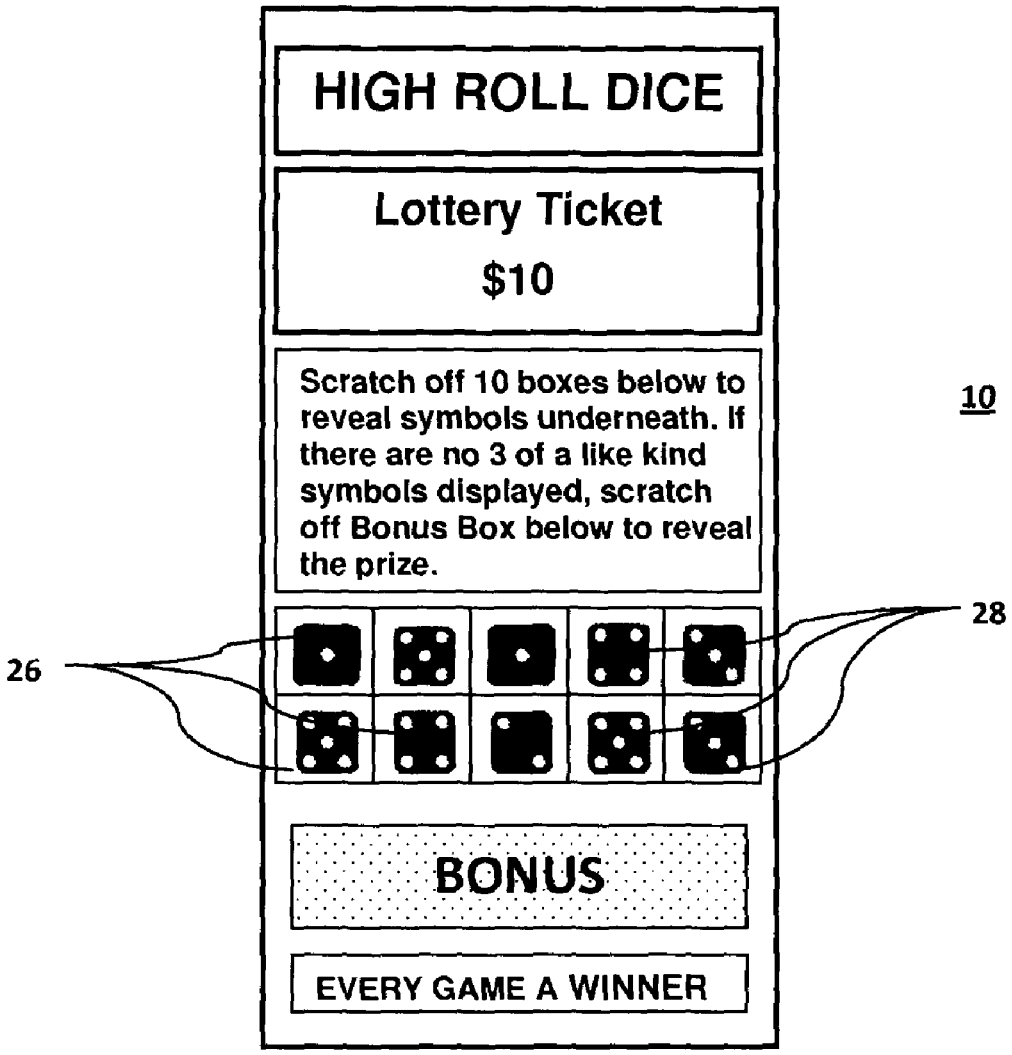
FIG. 2 depicts the instant lottery ticket shown in FIG. 1 with the scratch off material in the first playing section removed, and illustrating a winning combination in such section.

In the presently described embodiment, play area 14 of game ticket 10 includes ten boxes 26, each having scratch-off material 24 applied to cover outcome indicia 28 underneath (see FIG. 2). In the present example, the theme of the game is a dice game, as indicated by the name of the game "High Roll Dice" 20, so that in accordance with such theme outcome indicia 28 each have the appearance of dice or collectively the result of a roll of ten standard six-sided dice, with the resulting number 1 through 6 being indicated by one or more dots equal to such number on the face of the die. To play the game, as indicated by instructions 21, the player rubs off or removes the scratch-off material coating 24 from all ten boxes 28 in first play area 14 using the edge of a coin or the like, to reveal the outcome indicia 28. In FIG. 2, all ten of the outcome indicia are revealed, so that they player can now determine whether he or she is a winner. It is also contemplated alternatively that such first play area could be devised as a probability type game, wherein first the player removes scratch-off material 24 from over, for example, only five of the ten boxes 26 in the first play area, so that whether or not the player is a winner depends upon which boxes are scratched and the indicia underneath.

Once the indicia in first play area 14 has been revealed, according to the present method of play, if three or more like indicia or symbols are revealed, the player wins a payout equal to the amount indicated on payout schedule 21 on reverse side 13 of the ticket 10 (see again FIG. 4), wherein each outcome of three or more like indicia is accorded a payout value. In the present example, three 5's were revealed in play area 14, which according to payout schedule 21 equals a payout of $8.

Figure 3:
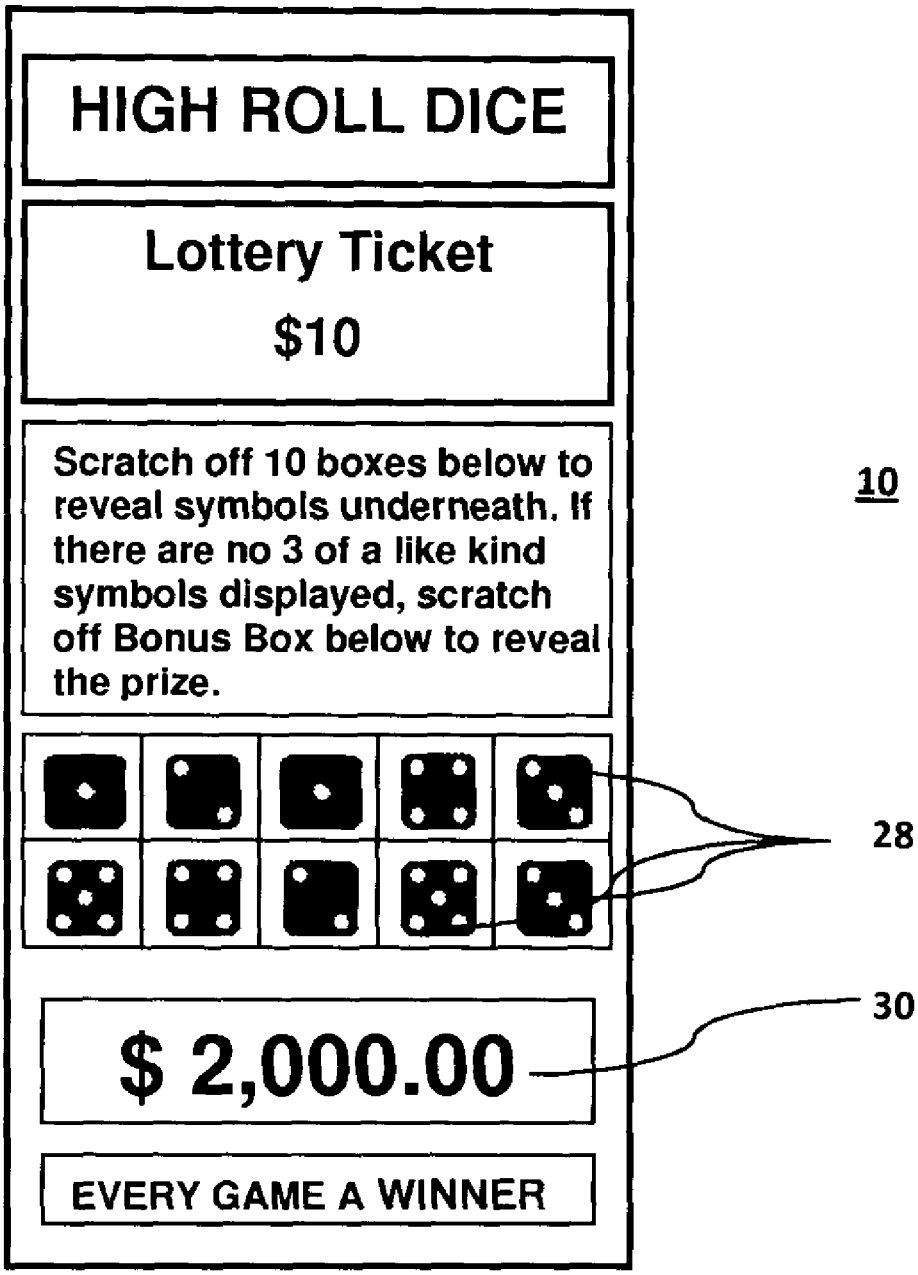
FIG. 3 depicts an instant lottery ticket similar to that shown in FIG. 1 with the scratch off material removed from the first playing section and second playing section, revealing a winning combination in the second playing section.
Figure 4:
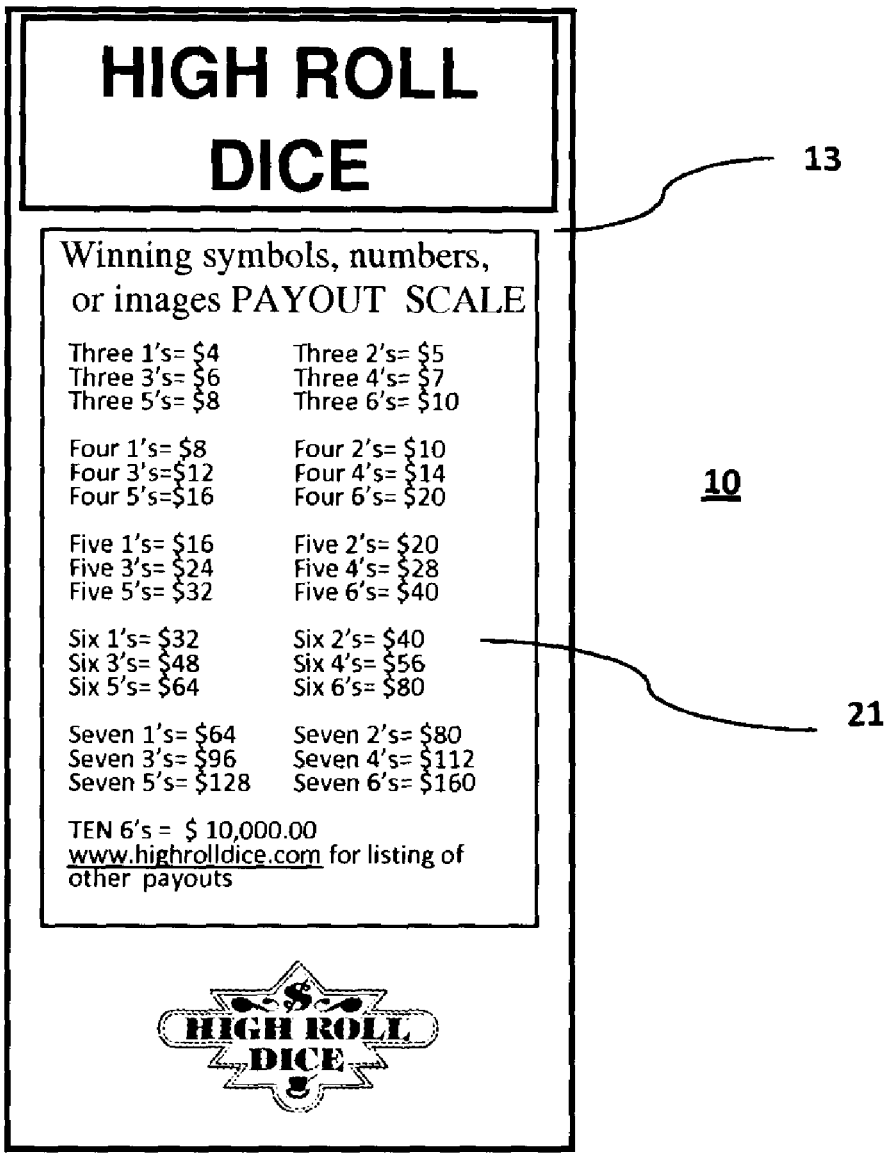
FIG. 4 illustrates the back or reverse side of an instant lottery ticket game in accordance with the system and method of the present invention.

Referring now to FIG. 3 there is shown another ticket 10 in accordance with the method of the present invention and having the same design as the ticket shown in FIGS. 1 and 2 but wherein upon removing coating material 24 from boxes 26 in first playing area 14, no three of the same kind or more dice or outcome indicia 28 are revealed, as there are two 1's two 2's, two 3's, two 4's, and two 5's. In this situation, according to instructions 20, the player then may remove the scratch-off material 24 from second play area or section 16, having the word "Bonus" thereon. Once removed, outcome indicia 30 is revealed, which in the present example equals a cash prize of $2000. Thus, in accordance with the preferred embodiment of the present game system and method, players will always receive a payout of some value in second playing area or section 16 if no winning combinations of outcome indicia are revealed in first playing area or section 14. Preferably, such payout 30 revealed in playing area or section 16 will be substantially larger than the average payout available from first playing section 14. While the second play area 16 is marked as "bonus", such marking is actually a misnomer as what is found there is not really a bonus for having won something else in the first play area, but more of a consolation prize for not having won something in the first game area, although "consolation" is not a good description either as this prize in the preferred embodiment of the invention at least is where the largest prize is found. Thus, a ticket that is not a winner in the first playing area or section 14 will always be a winner in the second playing area or section 16, so that every ticket or every game is a winner.

As shown in FIG. 3, the bonus, or usually the big winning of the lottery game of the invention is boldly stated as being $2000 in rather large numbers and this will constitute the usual way of such showing or notification of such win. However, it will be understood that such notification can be in any form including symbols and the like indicated on a separate portion of the card having a certain value or the like and could be an authorization for the granting of another lottery card for a future try.

Game tickets 10 are preferably arranged so that usually the outcome indicia 28 in first play area 14 will include at least one set of three like indicia, so that the player will already be a winner and will not proceed to remove the scratch-off material from the second play area 16, the results of which are only valid if the ticket does not contain at least three like kind indicia in first playing area 14. However, it is preferred to mark the second section as bonus as a matter of psychology and because it is a bonus section to the extent that if nothing is won in the first play section, one may go to the bonus section. Nevertheless, as was already indicated, every ticket 10 is a winning ticket in that if the player is not a winner in the first play section of the ticket, the player will always be a winner in the second play section or "Bonus" game.

As will be evident to those skilled in the art of gambling games, and particularly to gambling statisticians, the payouts based upon the two combined payout sites on the instant payoff card plus the cost of the instant payoff card itself will be calculated so that the total payout from both payout sections of a given batch of cards plus the cost of the cards themselves to the provider and the expenses of administering the sales and payout of the system for playing the game will be less than the payments made by purchasers of such batch of instant payout lottery cards. While it is preferable for the bonus section of the cards to generally have a fairly high payout, furthermore, and to have this payout conditioned upon not having winning numbers or combinations provided in the first section of the card, the arrangement of the winning extractable from or paid out by the card can also be arranged to be mainly from the first matching of numbers portion of the card. Furthermore, while the embodiment of the invention described hereinabove is the presently preferred embodiment of the game of the invention, such invention is broader still in that it comprises an instant lottery game that provides not only a possibility of a very large payout/payoff but also an assured payout or payback of at least a portion of the cost of purchasing the lottery ticket. There is believed to be a psychological advantage to establishing early on, i.e. when the matching of the dice numbers or other indicia in the first section provides a preliminary payout or win which can, for example, in or for a $10 value ticket be from $2 to $50 and when there is no winning number with a payout thereon becoming entitled to a try for the bonus which may have a payout, for example, of $50 to $25,000 or even in some cases $250,000 or more. In this manner the player is kept in suspense for a longer period and is more likely to purchase a further ticket, particularly if the players luck appears to be "on a role" so to speak. On the other hand, if the players chance of hitting a large jackpot rides mostly upon what the initial matching combinations are then once this stage is past the player will have a lesser interest in seeing what is available under the bonus section, already knowing that such bonus is likely to be fairly perfunctory or relatively low.

Of course, it is possible also to mix a high winning combination, or jackpot, into both groups or, in effect, divide a jackpot between both winning groups on a single card thereby keeping the player's interest high during the entire game. However, in a dice type scratch off step such as shown and described herein the number of combinations are somewhat limited to the number of dice face shown or other identifying images shown, whereas a bonus card scratch off section can have almost any assigned value in a large number of variations. Consequently, it is preferred to establish a number of relatively low variations of payoff from the first group of scratch off symbols and in general higher payouts under the bonus section of the instant payout card. Of course, just because the first or dice scratch off section of the lottery card shows a representation of dice does not compel the faces shown to be a statistically representative series of throws of dice faces, since any particular sequence of faces could be represented. Of course, if the lottery tickets should be represented as being made up of a statistically representative sequence of faces of dice coming up or which would come up in a series of throws then the faces would have to be shown on different lottery tickets in a statistically valid series of faces and more limitations would be placed upon the different combinations. In such case having the major payouts and variations of payouts relegated to the bonus section becomes even more important and convenient. However, even if a statistical representation is not adhered to, the fact that there are only so many faces to be shown on the normal dice and only so many combinations available on a limited number of dice both suitable for representation on a usual card as well as a limited number of dice faces that can be scanned and retained in memory when the usual player is checking to see what he or she has won by means of dice representations that the potential combinations are limited, making it more convenient to reserve a variety of large payouts to the bonus section.

As will be readily understood and as pointed out above, the depictions of dice faces on the first payout section of the instant payout section of the instant invention is only one possible sequence indication which could be equally as well any other representation of matching indicia such as sequence of balls or arrows or balls and triangles, numeral designations, alphanumeric indicia of various kinds, numbers plus place depictions of various animals or like as well as many other comparable indicia and themes. The depiction of playing cards has sometimes been popular and most serious gamblers are familiar with playing card faces, but there are some members of the public who are not that familiar with playing card faces. On the other hand, almost everyone is familiar with the faces of the normal dice set often from playing children's type board games. The criterion is only that the matching units be quickly scanable and interpretable or visually distinguishable by the player in order to determine if a winning combination has been attained or received.

To further this point, reference is now made to FIGS. 5-7, wherein two additional alternative embodiments of the instant lottery ticket and method of play of the present invention are illustrated. FIG. 5 illustrates an unused ticket 30 having a winter holiday theme, as indicated by the name of the game "Holiday Bonus" 40, so that in accordance with such theme outcome indicia 38 in FIG. 6 each have the appearance of a winter holiday related symbol such as a candle, gingerbread cookie, tree, bell, snowman, and Santa Claus head. In FIG. 7, another alternative instant lottery ticket 50 entitled "Lucky Symbol Bonus" 58 having a mixed generic theme is shown, with various easily identified but not necessarily related symbols 60, including a dollar sign, smiley face, heart, diamond, clover, and spade symbols. Such tickets use essentially the same method of play as the instant game ticket shown in FIGS. 1-4.

While the present instant game system and method is described with reference to an instant lottery ticket, the game could also be provided as an Internet or online lottery game, wherein the player uses his or her mouse to "scratch off" the coating material over the outcome indicia in the first and second playing areas, and the selections or results are recorded at the headquarters of the lottery organization operating the lottery. The present game system and method may also be applied in other types of game systems, such as a computer game or electronic game, or other types of gambling games.

Since, as explained above, an "Every Ticket a Winner" bonus lottery player will always win some sort of bonus payment, even if fairly minor, some way to conveniently collect such bonus is desirable. One way is to simply have the ticket holder present the card to the vendor and collect their small reward or bonus as they would usually do if they won a significant but infrequent winning payment or rewards with the usual prior art lottery card. However, the winning cards are rather infrequent with a normal prior art lottery card. However, where every card is a winner in accordance with the present invention, collecting the bonus would require two stops at and transactions with the usual vendors of such cards, resulting in extra labor for both the vendor and the player or customer. While some purchaser's of such cards might not believe it worthwhile to spend the extra time and labor to collect a small bonus and, therefore, might simply throw the cards away leaving basically more profit for either the vendor of the card or the gambling organization supplying the lottery cards and essentially underwriting other large winning payouts, depending upon the agreement of who would be responsible for payment of such small bonus amounts, the usual players will wish to collect their bonus.

Furthermore, some vendors in order to save time might merely vend the cards at a discount equal to the minimum generated bonus in order to avoid the extra labor and handling involved in such guaranteed payout or payback. This would defeat the psychological and practical advantages of having the bonus lottery player leave his or her small bonus with the gaming organization, whether private or public, however. Consequently, it is an advantage to physically register each player, obtaining their name and address either the first time they purchase one of the bonus lottery tickets or alternatively the first time they cash one in for the bonus payment. If they are a regular customer thereafter, their normal bonus can be recorded to their account thereafter. In such case, if they are not well known to the vendor, in which case because of such personal knowledge the vendor can automatically record their purchase when dispensing the customer's ticket from the lottery ticket vending machine roll or the like, the simplest arrangement in the case of a lesser known player is to issue them an identification card and have them agree that they do not simply collect their bonus in person at the time they present their ticket for payment of their bonus, such bonus will be accumulated on their account. Relatively few customers, or at least regular customers, will wish to collect each time.

Thereafter, such customers for bonus lottery cards can present their identification card to the vendor when purchasing their lottery card. As they pay their money to purchase the card which will be automatically applied to the purchase and any bonus associated with said card will be automatically added to their account. If the bonus payment is over some agreed upon trigger point they can then return to the vendor to collect such bonus which will be paid to them in cash or other specie, whereas, if the bonus is below a preset trigger point, they will not be able to collect it, but must maintain it in their account as a forced saving until a predetermined time at which time the entire account contents can be paid out, usually with interest, either by the vendor or by check from a central administration. Normally the interest will be taxable, but a bonus of a reasonable degree smaller than the cost of the ticket will not normally be taxable because of being actually in the nature of a discount on the price of the lottery ticket or an immediate discount. As pointed out above, the conversion of these bonus payments in effect to forced savings of a portion of the purchase price of every lottery ticket have psychological advantages as well as practical advantages, since not only do they make the usual lottery ticket buyer feel less guilty or subject to criticism for purchasing such lottery tickets in a search for the excitement and anticipation of a possible big win, but they also at least somewhat justify said purchases in the eyes of non-gambling family members or even non-gambling members of the general public who may not themselves be very much in favor of any sort of gambling, particularly as a regular practice or occurrence whether based on practical, religious or other grounds. As pointed out above, for example, the payout of the bonus payments on or near the birthday of a spouse followed by a meal in a good restaurant may be a particularly effective and convincing justification to one's spouse of the use of some family monetary resources in a search for a big payout with intermittent gambling highs during the actual purchase and examination of the lottery ticket for possible significant winnings.

Figure 8:
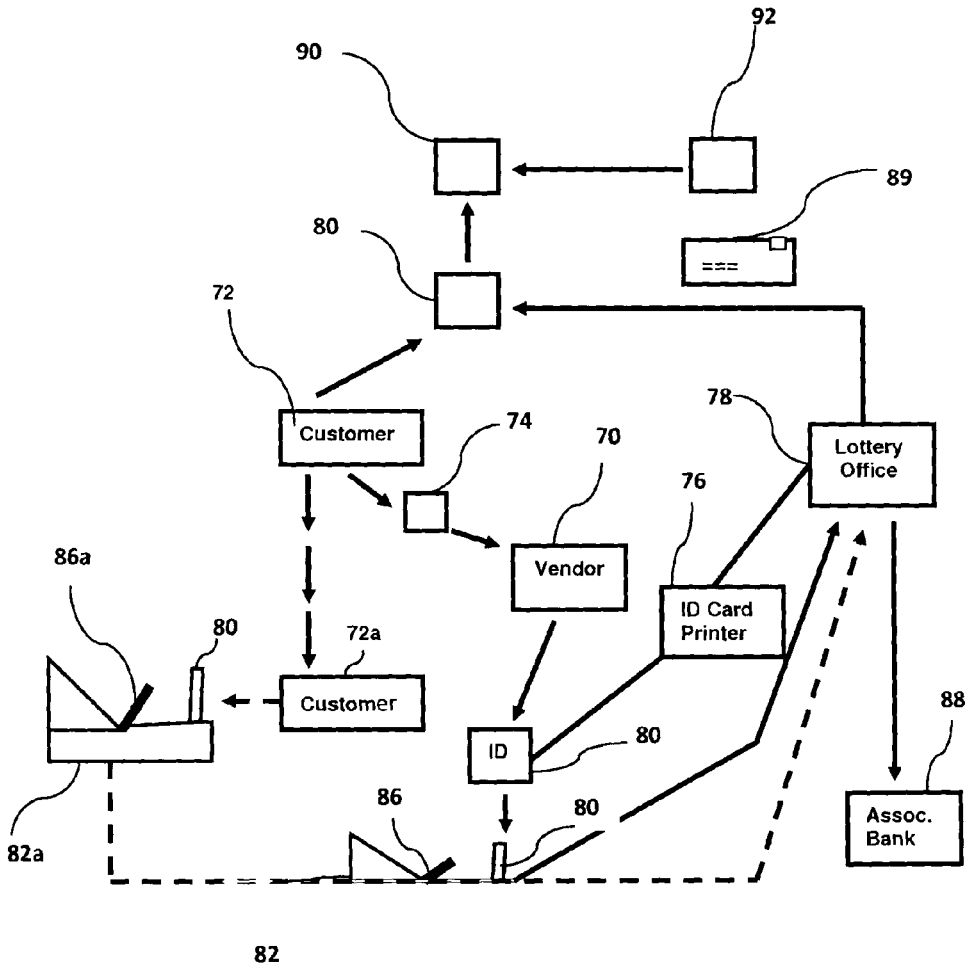
FIG. 8 is a flow chart illustrating an arrangement for purchasing and making bonus payouts in accordance with the instant lottery ticket of the present invention.

FIG. 8 is a flow chart or diagram of how a typical purchase of a lottery ticket and payout of the guaranteed bonus may be handled. In FIG. 8 a typical vendor establishment for lottery tickets and frequently also newspapers, magazines or other sundries is indicated by reference numeral 70. Such vendor 70 will have a supply of bonus lottery tickets usually in a roll or in a conventional card dispensing machine and upon the first purchase by customer 72 of a bonus lottery ticket will initially take the customer's name and address and enter this into an identification card printer 76 which will contact a central office or data center 78 which will electronically issue an ID number which can be electronically entered in ID card 80, which thereafter serves as the customer's or player's personal identification or ID card. Such printer 76 then will print an identification card, preferably electronically encoded from a central communication office. Receiving the funds 74 for purchase of the ticket the vendor will enter the customer's card into a slot on a ticket dispensing machine 82 and this will withdraw a lottery ticket 86 from a roll of tickets within the ticket dispenser 82. Preferably the ticket 86 will be previously electronically encoded to indicate the bonus amount which the ticket is worth and this will be automatically transmitted to the lottery office and entered together with the customer's ID number into an appropriate account set up for such customer. If the bonus is over a certain predetermined amount it can be immediately withdrawn by the customer or player and paid to the customer by the vendor 70. However, if it is below such amount it will be retained in the account until a date certain or until a predetermined amount is collected in the customer account. It should be understood that the card or literature provided with the card will provide that acceptance of such ID card will constitute acceptance of any rules with which the customer's account will be maintained and paid.

Of course, if the player 72 wishes to have the amount paid immediately this can be arranged. However, most players will be willing to leave the funds in the account until some predetermined date or amount certain is reached or accumulated, since the individual amounts are small and it is time consuming to withdraw, and furthermore, almost all players will take some satisfaction in the fact they are building up a saving fund, particularly if after a certain amount is accumulated they will preferably be provided a chance to obtain further enhancement of such customer's account such as a chance to double or triple the ultimate payout on a chance basis.

After the initial transaction the customer or player 72*a* will merely hand the vendor 70 his, i.e. the customer's, or her identification card and funds to play and the vendor will insert the ID card into the lottery card machine and hand the lottery card to the player for determination of what they in the normal manner won. However, as an alternative, the player 72*a* after paying the vendor can insert their own already issued ID card into the card dispensing machine 82*a* and receive a lottery card 86*a* directly, see the alternative procedure indicated in FIG. 8 by dashed lines.

If local or other legislation sets limits upon what a gambling business or organization can do with customer funds or payouts, an associated banking institution can be contracted with to handle player's paybacks or funds as indicated by 88 in FIG. 8. The lottery administrative office 78 may after a certain period contact the customer usually via mail 89 to indicate they can bring their identification card 80 to a wagering point 90 where by entering either ID card 80 into a terminal 92 their account if "aged" for an agreed period can be exposed to a possible multiplication on a random chance basis.

As will be evident from the above, the provision of a system whereby small bonuses or even, alternatively, all bonuses, except exceptionally large winnings, are entered into a savings fund as a form of forced savings has, as indicated above, considerable attraction for the average controlled gambler who enjoys lotteries or any other controlled gambling as a controlled sport which provides the so-called gamblers high or flush of excitement and anticipation available to an optimist in placing a bet and waiting to see if they have won. Since the responsible gambler, however, frequently feels at least a little guilty because others if not themselves, or society in general, feel guilty over "squandering" their money, particularly if they don't have much. However, a gambler knowing that every time they take a lottery card they are also saving something, which, when all is said and done, very few members of the public actually do, tends to at least partially ameliorate whatever small guilt they may feel. As explained, the savings feature also offers a ready-made excuse for playing the instant lottery either for the benefit of oneself or for the benefit of others.

As will have been evident from the above description and discussions as well as the appended drawings, the present inventor provides a new and intriguing instant lottery game which the innovation of both a two part play cycle and the award every time or for every game played of a bonus at the completion of the second play cycle, some or most of such bonuses being less than the original price of the lottery ticket, but still if aggregated over a period having the possibility of becoming significant if accumulated at least the lesser bonus payments as a form of forced saving in order to make the player feel more relaxed about spending money on lottery tickets, such accumulation over a period being encouraged in some cases by providing further wagering which can come into effect after set periods of accumulation in order to encourage the lottery game player to leave their smaller bonus amounts in the savings fund as long as possible, i.e. basically to encourage saving as a result of wagering and ameliorate in general any unfavorable opinion of lottery games or so-called "playing the lottery".

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A method of playing an instant lottery ticket game comprising:

(a) obtaining by payment of a single fee one or more instant lottery game tickets each including a first playing area having a series of scratch-off locations under which a plurality of related indicia are visible upon removing an opaque covering, and a second playing area having at least one scratch-off location also with an opaque covering applied, in which either said first playing area or said second playing area contains an indication of a prize or payment due to an authorized holder of the ticket such that a prize or payment is awarded in every ticket;

(b) removing the opaque covering from the first playing area of the ticket;

(c) examining the related indicia revealed in the first playing area and determining whether any winning combinations of said related indicia are present;

(d) in the event a winning combination of related indicia is present in the first playing area, turning in the ticket to collect the prize or payment associated with the winning combination, and ending the game without removing the opaque covering from the scratch-off location in the second playing area;

(e) only in the event no winning combination of related indicia is present in the first playing area, removing the opaque covering from the scratch-off location in the second playing area to reveal a prize or payment awarded to the authorized ticket holder; and (f) collecting the prize or payment indicated in the second playing section.

2. A method of playing an instant lottery game in accordance with claim 1 in which if a designated number of like kind outcome indicia are revealed in said first playing area, the ticket is a winning ticket and the payout to be awarded is determined by comparing the combination of outcome indicia to a payout table.

3. A method of playing an instant lottery game in accordance with claim 1 in which said game is simulative of a dice game and includes depictions of a plurality of die faces in the first playing area, and if three or more like kind die faces are revealed in the first playing area, the ticket is a winning ticket in the first playing area.

4. A method of playing an instant lottery game in accordance with claim 3 in which the player matches indicia in the form of die faces found under the scratch-off coating after scratching off such coating to determine if a winning combination of die faces is present as indicated by the list of winning die combinations.

5. A method of playing an instant lottery game in accordance with claim 2 in which the value of a prize or payment awarded in accordance with the second playing area is on average greater than the value of the usual prize or payment awarded in the first playing area over any substantial number of tickets.

6. A method of playing an instant lottery game in accordance with claim 5 in which monetary prizes or payment awarded in said second playing area are accumulated in an individual account for the player until a sum certain is accumulated, and then paid out.

7. A method of practicing an instant lottery ticket game, comprising the steps of:

(a) issuing an instant lottery game ticket to a player, said ticket having at least a first play area having a series of scratch off locations under which a plurality of related indicia are visible upon removing an opaque covering, and a second play area having at least one scratch off location also with an opaque covering applied, in which a game in the second play area is only played if the results of play of a game in the first play area does not result in the player winning in said game;

(b) the player removing the opaque covering from the first playing area of the ticket and playing the game in the first play area, and if the player wins in the game in the first play area, the player turning in the instant lottery game ticket to receive the indicated winnings, and ending the game without playing the game in the second play area;

(c) in the event the player does not win in the game in the first play area, the player removing the opaque covering from the second playing area of the ticket and playing the game in the second play area, which game is guaranteed to be a winner, and the player turning in the instant lottery game ticket to receive the indicated winnings.

8. A method of practicing an instant lottery ticket game in accordance with claim 7 in which the game in the second play area is a continuation of the game in the first play area.

9. A method of practicing an instant lottery ticket game in accordance with claim 7 in which the game in the second play area is a separate game from the game in the first playing area.

10. A method of practicing an instant lottery ticket game in accordance with claim 7 in which the player may elect to have monetary awards electronically deposited into an account.

11. A method of practicing an instant lottery ticket game, comprising the steps of:

(a) issuing an instant lottery game ticket to a player, said ticket having a game play area containing a game of chance having a series of scratch off locations under which a plurality of related indicia are visible upon removing an opaque covering, and an instant award area having at least one scratch off location also with an opaque covering applied, in which the instant award area is only utilized if the result of play of the game of chance in the game play area does not result in the ticket holder winning in said game of chance;

(b) the ticket holder removing the opaque covering from the game play area of the ticket and playing the game of chance in the game play area, and if the ticket holder is a winner in the game of chance, the ticket holder turning in the instant lottery game ticket to the agency administering the instant lottery game and collecting the indicated winnings, and ending the game without utilizing the instant award area;

(c) but in the event the ticket holder is not a winner in the game of chance in the game play area, the player removing the opaque covering from the instant award area of the ticket and receiving an instant award indicated in the instant award area, and turning in the instant lottery game ticket to the agency administering the instant lottery game and collecting the indicated instant award.

* * * * *